United States Patent [19]

Powers

[11] Patent Number: 4,972,124

[45] Date of Patent: Nov. 20, 1990

[54] ELECTRONIC BALLAST INVERTER

[76] Inventor: Charles D. Powers, 987 E. Del Mar Ave. Apt 9, Pasadena, Calif. 91106

[21] Appl. No.: 464,205

[22] Filed: Apr. 12, 1990

[51] Int. Cl.[5] ..... H05B 37/02

[52] U.S. Cl. ..... 315/219; 315/224; 315/DIG. 5; 315/DIG. 7

[58] Field of Search ..... 315/209 R, 209 T, 219, 315/224, 226, DIG. 5, DIG. 7

[56] References Cited

U.S. PATENT DOCUMENTS

| | | | |
|---|---|---|---|
| 4,060,752 | 11/1977 | Walker | 315/DIG. 5 |
| 4,127,795 | 11/1978 | Knoll | 315/DIG. 5 |
| 4,199,710 | 4/1980 | Knoll | 315/DIG. 5 |
| 4,237,403 | 12/1980 | Davis | 315/DIG. 5 |
| 4,245,177 | 1/1981 | Schmitz | 315/DIG. 5 |
| 4,259,614 | 3/1981 | Kohler | 315/DIG. 7 |
| 4,259,616 | 3/1981 | Smith | 315/DIG. 7 |
| 4,277,726 | 7/1981 | Burke | 315/DIG. 7 |
| 4,277,728 | 7/1981 | Stevens | 315/DIG. 8 |
| 4,469,988 | 9/1984 | Cronin | 315/DIG. 5 |
| 4,513,226 | 4/1985 | Josephson | 315/DIG. 7 |

*Primary Examiner*—Robert J. Pascal

[57] ABSTRACT

A current fed half-bridge parallel resonant inverter for powering one or more discharge-type lamps is comprised of a bifilar wound current feed choke placed in series with a transformer whose secondary resonates with a capacitance placed across the secondary. The bifilar current feed choke is connected in such a way as to insure that that current flows through alternate windings on alternate half cycles of the inverter. Each half of the primary circuit is comprised of one winding of the current feed choke, transformer primary winding, and a switch such as a transistor or the like. An inherent feature of the half-bridge design is that the two halves of the primary circuit operate at different DC offsets. A means is provided for alternately switching the switches of each half of the primary circuit on and off through additional windings of the transformer. A further winding is provided on the transformer to detect lamp ignition through detection of the frequency shift of the inverter caused as current through the lamp after ignition begins to flow through the reactive current limiting element in series with the lamp.

6 Claims, 3 Drawing Sheets

ELECTRONIC BALLAST INVERTER

BACKGROUND OF THE INVENTION

Parallel resonant push-pull inverters, series resonant push-pull and half-bridge inverters, and these and other variations of non-resonant inverters have all been used in an attempt to power discharge lighting. Though some are successful in accomplishing the objective, there are drawbacks which would indicate that an alternative method would be more suitable. Parallel resonant type inverters impose extremely high voltage demands on the switching transistors thus increasing cost and offer no inherent load imbalance correction. Series resonant type inverters usually use a high voltage generated across a capacitor through series resonance to cause ignition of the lamp and then revert to non-resonant operation as the series capacitor is shunted by the lamp after ignition. Therefore, these types of inverters as well as the non-resonant types suffer from high levels of RFI generation through square wave operation, an operating frequency which is usually dependant on input voltage and/or load current, as well as reduced switching efficiency as compared to inverters which operate continuously in the resonant mode.

The prior art also encompasses a half-bridge resonant inverter which is composed of two matched resonant circuits on the primary side of the transformer. This circuit, however, is of complex construction and difficult to reliably produce as both primary resonant circuits must be exactly matched.

It is well known by those versed in the art that high intensity discharge lamps require an initial very high voltage pulse to start the arc and that the value of the voltage required is dependant upon the duration of the pulse which cannot exceed the time duration of one half of the oscillating frequency. As the frequency increases, the value of the starting voltage increases and may be many thousands of volts. These starting voltages are both dangerous and expensive to contain. As a consequence, current electronic inverter ballasts for these types of lamps are both expensive and complex to manufacture.

Examples of prior art circuits are shown in the following patents:

| | | |
|---|---|---|
| 4,513,226 | 4/1985 | Josephson |
| 4,469,988 | 9/1984 | Cronin |
| 4,277,728 | 7/1981 | Stevens |
| 4,277,726 | 7/1981 | Burke |
| 4,259,616 | 3/1981 | Smith |
| 4,259,614 | 3/1981 | Kohler |
| 4,245,177 | 1/1981 | Schmitz |
| 4,237,403 | 12/1980 | Davis |
| 4,199,710 | 4/1980 | Knoll |
| 4,127,795 | 12/1978 | Knoll |
| 4,060,752 | 11/1977 | Walker |
| 4,060,751 | 11/1977 | Anderson |
| 4,004,187 | 1/1977 | Walker |
| 3,754,160 | 8/1973 | Jensen |

BRIEF DESCRIPTION OF THE INVENTION

This invention relates to a half-bridge resonant inverter which is of extremely simple and economical construction yet is capable of highly reliably and efficiently powering discharge-type lamps. Additionally, this invention relates to the design of an inverter which is inherently capable of load imbalance correction such as may occur from uneven electrode wear over the life of a discharge-type lamp or alternatively from lamp starting techniques which require an imposed DC voltage across the lamp to cause ignition.

The objective of the present invention includes the design of a circuit which is simple, reliable and economical to manufacture while maintaining all of the advantages of both the half-bridge and resonant type inverter.

The circuit of the half-bridge resonant inverter according to the present invention consists of two primary switching circuits operating at a DC offset to each other. This DC offset is equal to one half of the supplied DC input voltage. Each half of the primary circuit consists of a switch such as a transistor in series with one of the windings of the bifilar current feed choke and the primary of the power conversion transformer. Each half of the primary circuit is current fed from a single choke wound in a bifilar manner and connected such that each winding of the choke has an equal inductance. One end of each winding, of opposite polarity, is connected together basically forming a center-tapped winding on the choke. This center-tap is connected to one side of the transformer primary and each of the remaining ends of the winding is connected to a switching element. A means is provided through additional windings in the transformer to alternately turn on the switches in each primary circuit. Furthermore, a means is provided for starting oscillations of the circuit at any time power is applied.

Another objective of the present invention is to provide an electronic inverter ballast circuit which provides for load imbalance correction. As discharge type lamps age, usually one or the other of the electrodes in the lamp begins to wear away. As this electrode begins to deteriorate, arc voltage across the lamp begins to increase in one direction thereby causing an imbalance which causes further detrioration and consequently lamp life and performance is shortened. Additionally, if this situation is not corrected, load imbalance could cause transformer core flux walking which could eventually destroy the inverter.

A further object of the invention is to provide a means for detecting lamp ignition. The secondary circuit consists of an LC resonant circuit. A capacitor is placed directly across the secondary of the transformer providing an initial path for current return. There may also be some capacitance in parallel with the primary. It is this total capacitance and inductance which establishes the initial resonant frequency. A further capacitor or inductor is connected in series with the load and one leg of the secondary. It is this capacitor or inductor which actually provides the current limiting or ballasting function of the inverter. The other leg of the secondary is connected to the other terminal of the load thereby providing the current return path of the secondary circuit which would show either RL, RC, or RLC characteristics. The total combined inductance and capacitance of the transformer circuit thereby establishes the oscillating frequency which is independent of the applied voltage. Without lamp ignition or with either a short circuit or open circuit the oscillation frequency will change due to the altered reactance of the entire transformer circuit. Therefore, detection of this altered frequency after a suitable time delay could be used to shut down the inverter.

A still further object of the present invention is to provide a means for starting metal-halide or sodium type lamps which require an initial high voltage to start ignition. By applying a DC bias across the lamp the lamp may be reliably started at a much lower voltage which is essentially independent of the inverter operating frequency. Therefore, a winding on the secondary of the transformer capable of generating an adequate voltage is current limited through an extremely high value resistor, rectified and used to generate a DC potential across the load. Though this voltage is of a relatively high potential, the current is extremely small. Any imbalances caused through the introduction of this DC bias will be compensated and corrected by the inherent balancing characteristics of the half-bridge circuit.

The simplicity, economy, and reliability as well as other advantages of this invention will become more apparent through examination of the drawings and descriptions.

DESCRIPTION OF A PREFERRED EMBODIMENT

Figure 1:
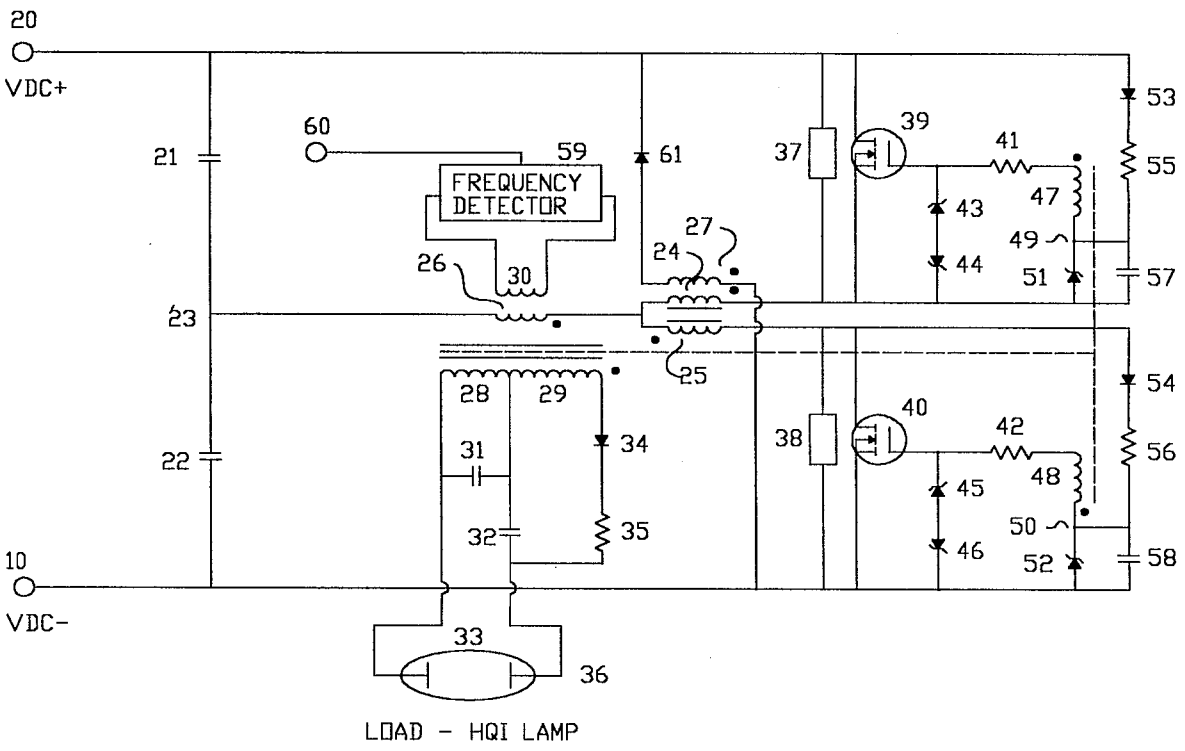
FIG. 1 represents the circuit implemented as an inverter-ballast with a load consisting of a metal halide or sodium type discharge lamp.

The following description relates to an implementation of the circuit with a load consisting of an HQI lamp. This is represented by FIG. 1.

The positive input terminal 20 and the negative input terminal 10 are provided as a means to input a DC voltage to the circuit. A voltage divider consisting of capacitors 21 and 22 serves to generate at point 23 a voltage which is substantially equal to one half of the DC input voltage. Under static conditions and just prior to start-up, a current flows to the negative terminal through zener diode 52 through resistor 56, diode 54, winding 25 of the choke, and winding 26 of the transformer to point 23. This develops a DC potential across capacitor 58 which is equal to the zener voltage of zener diode 52. This DC potential developed at point 50 which is supplied to the gate of transistor 40 through transformer winding 48 and resistor 42 is equal to approximately 4.7 volts. This is within the threshold region of transistor 40 such that some small current will begin to flow through transistor 40. Furthermore, the DC voltage at point 50 represents a DC offset to winding 48. Additionally, current flows to terminal 23 through winding 26 of the transformer, wnding 24 of the choke, through zener diode 51, resistor 55, and diode 53 out of the positive input terminal 20. This creates a DC voltage across capacitor 57 which is applied through winding 47 of the transformer and resistor 41 to the gate of transistor 39. Again, this voltage is approximately 4.7 volts and is within the threshold region of transistor 39 such that some small current will begin to flow through transistor 39. This voltage developed at point 49 represents a DC offset to winding 47 of the transformer.

The inverter is now in an unstable state as there is a small current flow through the transistors. One or the other of the transistors will conduct more heavily. For purposes of explanation, assume transistor 40 conducts more heavily than transistor 39. As current flows through transistor 40, transformer winding 26 and choke winding 25, a voltage with a positive potential is developed across transformer winding 48 with respect to the gate of transistor 40. This voltage is applied to the gate of transistor 40 through resistor 42 and serves to drive transistor 40 into full conduction. Simultaneously, a voltage is developed across transformer winding 47 with a negative potential with respect to the gate of transistor 39. This voltage, applied to the gate of transistor 39 through resistor 41 drives the transistor down through the threshold region into full cut off. Diode 54 prevents the discharge of capacitor 58 during the on time of transistor 40 thus maintaining a DC offset for transformer winding 48.

As the circuit therefore begins oscillation, current flow in transformer primary 26 causes a voltage to be induced in transformer secondary 28. Secondary 28 and capacitor 31 form a parallel resonant circuit of a specific frequency as determined by the inductance of transformer secondary 28 and the capacitance of capacitor 31. It is this resonance which creates a sine wave which in turn impresses a voltage across all windings of the transformer. Additionally, current flow across winding 25 of the current feed choke causes a voltage drop across this winding which is transformed by the transformer action of this choke to a voltage potential which is developed across its companion bifilar wound winding 24. It is this voltage potential which provides an offset to winding 26 of the transformer such that the voltage applied to the source of transistor 39 is equal to approximately one half of the voltage that would have been applied if this inverter were a push-pull parallel resonant type.

The sine wave created in the transformer secondary resonant circuit which has a current component 90 degrees out of phase with the voltage component and which is impressed across transformer winding 26 causes back emf which will then cause the voltage across winding 26 to fall to zero and then begin to reverse. Also, the voltage impressed across winding 48 falls to zero and begins to reverse turning off the gate of transistor 40. As transistor 40 is turned off, transistor 39 is turned on as voltage begins rising in transformer winding 47, this winding being of opposite polarity to winding 48. The oscillation of the circuit continues as outlined above with the exception that the transistor 39 is now in the conducting state, current now flows through choke winding 24, and the polarities across all transformer windings are reversed. The voltage impressed across winding 26 of the transformer and applied to the drain of transistor 40 is offset by the voltage developed across choke winding 25. Again, the current in the secondary resonant circuit causes a back emf which is impressed across all windings of the transformer causing transistor 39 to turn off, turning on the gate of transistor 40 and continuing the oscillation.

During operation of the inverter, there may be occasion when secondary circuit energy or energy stored in the current feed choke needs to be returned to the input power source. This might occur during such time as the transistors are switching and both transistors are off or alternatively, if the lamp were to stop conducting or during initial lamp ignition. Therefore, winding 27 on the current feed choke will dissipate energy through diode 61 back to the DC input terminals. This prevent high voltage spikes from being created which may destroy the switching transistors.

Further, as oscillation of the circuit begins, a high voltage is developed across winding 29 of the transformer and is retified by rectifier 34, current limited by high value resistor 35 and applied to point 36, which is one terminal of the lamp and also one end of current limiting capacitor 32. This DC current which is extremely small causes the charging of capacitor 32 until such a point that the breakover voltage of lamp 33 is reached. Once the lamp begins conducting, current flows through capacitor 32 which current limits the value to that as required by the lamp. It is through this mechanism of applying a DC bias to the lamp and the consequently longer time constant of a DC that much lower potentials may be used to cause the lamp gases to ionize and begin conduction.

The half-bridge nature of the circuit is such that unequal currents flowing in and out of point 23 create a DC offset from the usual potential of this point of one half the DC input voltage to the circuit. This DC offset acts in such a manner as to balance the current flow in and out of point 23 and consequently through transformer winding 26 so as to maintain an equal flux through the transformer in both directions. This is the mechanism through which an imbalance correction occurs. This imbalance may be due to unequal electrode wear in the load or may be induced through the DC bias starting mechanism. Consequently, lamp life may be extended and circuit integrity maintained.

As current flows through the lamp and capacitor 32, capacitor 32 now becomes a reactive element in the secondary parallel resonant circuit and causes a shift of frequency of oscillation of the circuit. It is through detection of the frequency shift which is extracted from the circuit through transformer winding 30 either as a current or a voltage and is detected through various means currently known in the art that a control signal is developed which is used to detect lamp ignition.

Zener diodes 43, 44, and 45, 46 which are placed back to back and across the gates of transistors 39 and 40 are common pratice in the art for preventing voltage spikes at the gates which may destroy the transistors. Furthermore, transient suppressors 37 and 38 which are placed across the source/drain junctions of transistors 39 and 40 are also common practice to prevent voltage spikes from developing which could cause an avalanche condition which also may destroy the transistors.

Figure 2:
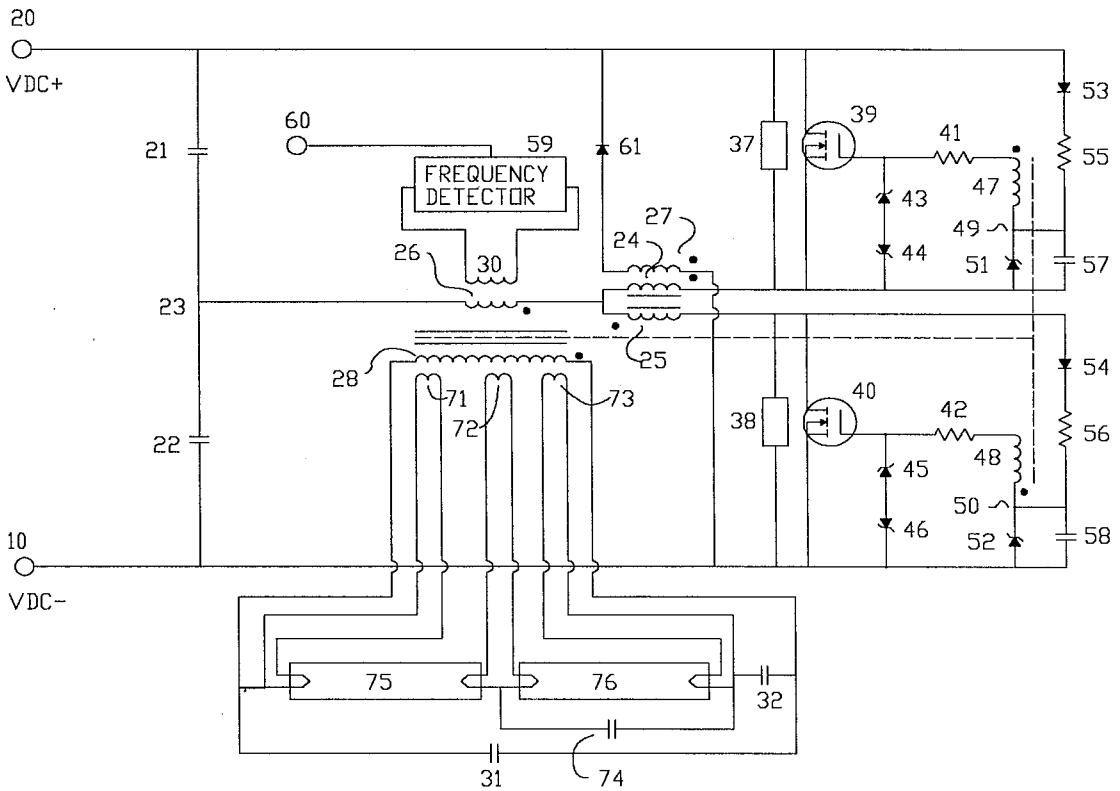
FIG. 2 represents an implementation of the inverter adapted to power fluorescent tubes.

Refer now to FIG. 2 in which the circuit of FIG. 1 has been modified to drive fluorescent lamps such as tubes 75 and 76. The basic circuit of FIG. 1 is unchanged except as discussed below and the same reference numerals have been used in FIG. 2 as in FIG. 1 to indicate the same type of components. In FIG. 2, filament heater windings 71, 72, and 73 have been added to the transformer secondary. Capacitor 74 has been added to assit in lamp ignition by placing a higher voltage across one tube first until it ignites after which a high potential will then be applied to the unlit tube. Winding 29, diode 34, and resistor 35 which represent the DC bias starting elements have been eliminated as being of no use in this application. The operation of the embodiment of FIG. 2 is basically the same as the operation of the embodiment of FIG. 1.

Figure 3:
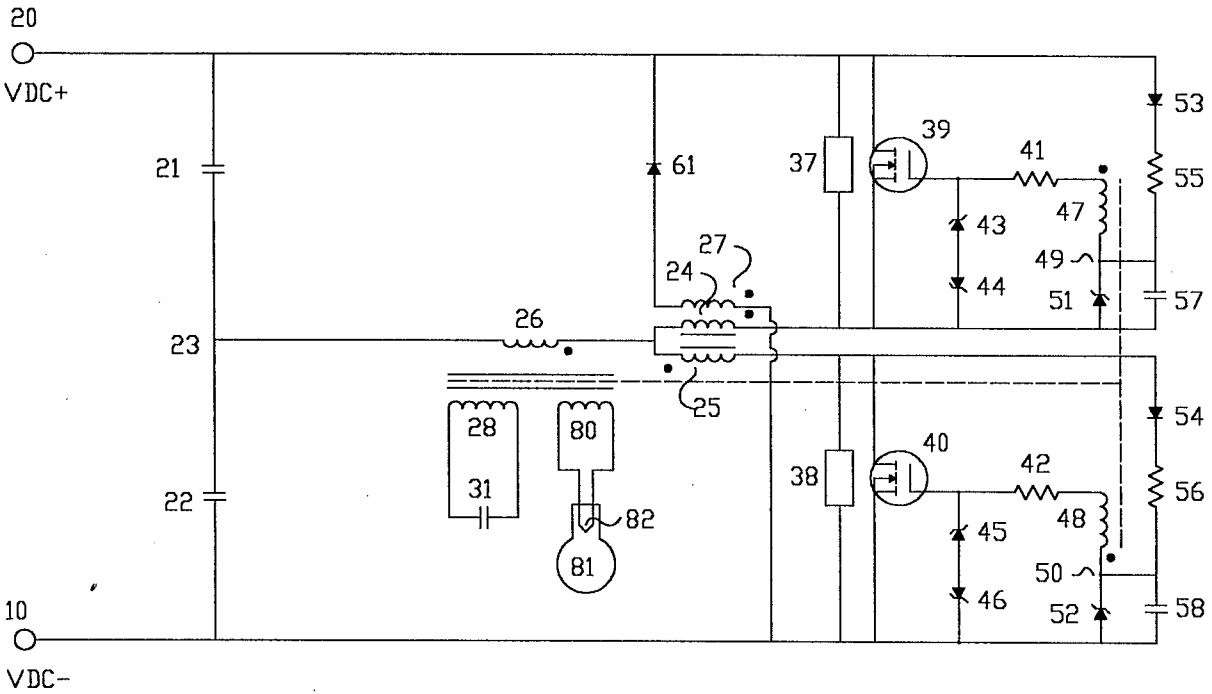
FIG. 3 shows how the circuit may be adapted to power an incandescent lamp such as a halogen lamp.

Refer now to FIG. 3 in which the circuit of FIG. 1 has been modified to drive a halogen lamp as indicated by 81. The basic circuit of FIG. 1 is unchanged except as discussed below and the same reference numberals have been used in FIG. 3 as in FIG. 1 to indicate the same type of components. Lamp filament 82 which represents a purely resistive load to the inverter is powered by the voltage developed across winding 80. It is possible to eliminate winding 28 and place the resonant capacitor across primary winding 26. The frequency detection portion of the circuit has been eliminated as there is no frequency shift whether the lamp is lit or not as the lamp filament presents no reactance to the circuit. Otherwise, the operation of the embodiment of FIG. 3 is basically the same as the operation of the embodiment of FIG. 1.

In carrying out this invention, I have demonstrated its operation employing the following components:

| High Intensity Discharge lamp ballast as depicted in FIG. 1: | |
|---|---|
| lamp 33 | 70 watt metal halide HQI lamp |
| capacitors 21 and 22 | 10 uF/250 VDC metallized |
| transformer | |
| core | Magnetics PQ-44040-Pw/0.040" gap |
| winding 26 | 34T AWG 22 HPN |
| windings 47 and 48 | 5T AWG 28 HPN |
| winding 28 | 300T AWG 22 HPN |
| winding 29 | 300T AWG 36 QPN |
| winding 30 | 4T AWG 30 HPN |
| current feed choke | |
| core | Micro-Metals T130-26 |
| windings 24 and 25 | 114T each AWG 24 bifilar wound |
| winding 27 | 228T AWG 28 |
| capacitor 31 | 0.022uF/2000VDC polypropylene |
| capacitor 37 | 0.033uF/2000VDC polyproylene |
| capacitors 57 and 8 | 10uF/15VDC tantalum |
| resistor 35 | 5 M ohm |
| resistors 41 and 42 | 330 ohms |
| resistors 55 and 56 | 12K ohms |
| zener diodes 51 and 52 | 1N751 |
| zener diodes 44 and 46 | 1N4744 |
| zener diodes 43 and 45 | 1N3027A |
| diode 35 | ESJA54-06 |
| diodes 53, 54, and 61 | MUR140 |
| transient suppressors 37 and 38 | SA170 (2 connected in series) |
| transistors 39 and 40 | IRF830 |

| Fluorescent lamp ballast as depicted in FIG. 2: | |
|---|---|
| fluorescent lamps 75 and 76 | 40 watt pre-heat rapid start tubes |
| capacitors 21 and 22 | 1uF/250VDC metallized |
| transformer | |
| core | Magnetics PQ-43230-Pw/0.020" gap |
| winding 26 | 20T AWG 22 HPN |
| windings 47 and 48 | 2½T AWG 28 HPN |
| winding 28 | 150T AWG 24 HPN |
| windings 71 and 73 | 1T AWG 24 HPN |
| winding 72 | 2T AWG 24 HPN |
| winding 30 | 2T AWG 30 HPN |
| current feed choke | |
| core | Micro-Metals T130-26 |
| windings 24 and 25 | 114T each AWG 24 bifilar wound |
| winding 27 | 228T AWG 28 |
| capacitor 31 | 1000pF/2000VDC polypropylene |
| capacitor 37 | 4700pF/2000VDC polyproylene |
| capacitor 74 | 470pF/630VAC polypropylene |
| capacitors 57 and 8 | 10uF/15VDC tantalum |
| resistors 41 and 42 | 330 ohms |
| resistors 55 and 56 | 12K ohms |
| zener diodes 51 and 52 | 1N751 |
| zener diodes 44 and 46 | 1N4744 |
| zener diodes 43 and 45 | 1N3027A |
| diodes 53, 54, and 61 | MUR140 |
| transient suppressors 37 and 38 | SA170 (2 connected in series) |
| transistors 39 and 40 | IRF830 |

| Inverter for powering 12 volt halogen lamps as depicted in FIG. 3: | |
|---|---|
| lamp 81 | 75 watt/12 volt halogen lamp |

-continued

| Inverter for powering 12 volt halogen lamps as depicted in FIG. 3: | |
|---|---|
| capacitors 21 and 22 | 1uF/250VDC metallized |
| transformer | |
| core | Magnetics PQ-43230-Pw/0.020" gap |
| winding 26 | 20T AWG 22 HPN |
| windings 47 and 48 | 2 ½T AWG 28 HPN |
| winding 28 | 150T AWG 24 HPN |
| winding 80 | 3T AWG 22 × 4 strands |
| current feed choke | |
| core | Micro-Metals T130-26 |
| windings 24 and 25 | 114T each AWG 24 bifilar wound |
| winding 27 | 228T AWG 28 |
| capacitor 31 | 4700pF/2000VDC polypropylene |
| capacitor 57 and 8 | 10uF/15VDC tantalum |
| resistors 41 and 42 | 330 ohms |
| resistors 55 and 56 | 12K ohms |
| zener diodes 51 and 52 | 1N751 |
| zener diodes 44 and 46 | 1N4744 |
| zener diodes 43 and 45 | 1N3027A |
| diodes 53, 54, and 61 | MUR140 |
| transient suppressors 37 and 38 | SA170 (2 connected in series) |
| transistors 39 and 40 | IRF830 |

The above embodiments are merely illustrative of this invention and are not to be considered as limiting. One of ordinary skill in the art might make changes without departing from the spirit of this invention. Rather, the invention is defined by the following claims including the protection afforded by the Doctrine of Equivalents.

I claim:

1. A half-bridge parallel resonant inverter circuit for powering one or more discharge type lamps consisting of:

a pair of input terminals for receiving a unidirectional voltage;

a voltage divider placed across said pair of input terminals such that a first portion of the input voltage appears across one input terminal and an intermediate terminal and a second portion of the input voltage appears across the other input terminal and said intermediate terminal;

a transformer having primary winding and at least one secondary winding adapted to be used to power at least one discharge type lamp;

a current feed choke with at least two windings connected such that the positive polarity of one winding and the negative polarity of the other winding are connected together and said connection is further connected to one terminal of said transformer primary;

a first circuit consisting of said transformer primary, one first winding of said current feed choke, and one first semiconductor switch connected in series, the other terminal of said first semiconductor switch being connected to the positive input terminal;

a second circuit operating at a DC offset to said first circuit consisting of said transformer primary, one second winding of said current feed choke, and one second semiconductor switch connected in series, the other terminal of said second semiconductor switch being connected to the negative input terminal;

a parallel resonant tank circuit consisting of at least one capacitor placed in parallel with inductance of said transformer;

means for alternately switching on and off said first and said second semiconductor switch at a rate determined by the resonant frequency of said parallel resonant tank circuit.

2. The inverter circuit of claim 1 further comprising a means to alternately turn on and off said first and second semiconductor switch, such means consisting of a fourth and fifth gate or base winding on said transformer;

said fourth and fifth windings being of opposite polarity and one end of each of said windings being connected through some resistance to one of each of the gate or base terminals of said first and second semiconductor switches such that when one of said semiconductor switches is conducting, its associated winding will have a positive potential and the associated winding of said gate or base terminal of the other said semiconductor switch will have a negative potential;

the opposite end of said third winding is connected to a voltage which is a positive DC offset from the negative terminal of its associated semiconductor switch, and the opposite end of said fourth winding is connected to a voltage which is a positive DC offset from the negative terminal of its associated semiconductor switch.

3. The inverter circuit of claim 1 further comprising a means to initiate oscillation whenever a DC voltage is applied to said input terminals, such means consisting of;

a first diode, a first resistor, and a first zener diode, said first zener diode being shunted by an associated capacitor;

the anode of said first diode connected to the positive terminal of said first semiconductor switch and the cathode of said first diode connected in series with a current limiting resistor to the cathode of said first zener diode;

the anode of said first zener diode connected to the negative terminal of said first switch;

the cathode connection of said first zener diode further connected to said associated gate or base drive winding of said transformer such that a bias is placed on the gate or base terminal of said first semiconductor switch through the DC offset placed on the said associated base or gate winding of said transformer;

whereby, said first semiconductor switch is biased into the threshold region where some small current will begin to flow through said first switch;

further, a second diode, a second resistor, and a second zener diode, said second zener diode being shunted by an associated capacitor;

the anode of said second diode connected to the positive terminal of said second semiconductor switch;

the cathode of said second diode connected in series with a said second current limiting resistor to the cathode of said second zener diode;

the anode of said second zener diode connected to the negative terminal of said second switch;

the cathode connection of said second zener diode further connected to said second associated gate or base drive winding of said transformer such that a bias is placed on the gate or base terminal of said second semiconductor switch through the DC offset placed on the said second associated base or gate winding of said transformer;

whereby, said second semiconductor switch is also biased into the threshold region where some small current will begin to flow through said second switch. Voltages will be developed in the said associated base or gate drive windings of said transformer and as one of said semiconductor switches will invariably begin conducting more heavily it will be driven on while the other semiconductor switch will be driven off.

4. The inverter circuit of claim 1 further comprising a means for ballasting one or more discharge type lamps from a said secondary winding of said transformer consisting of at least one capacitor placed in series with the lamp;

one terminal of said capacitor connected to one end of said secondary winding and the other terminal of said capacitor connected to one terminal of the lamp, the other terminal of the lamp connected to the opposite end of said secondary winding such that;

when current is flowing through the lamp, the capacitance of said ballasting capacitor adds to the capacitance of said resonating capacitor lowering the frequency of oscillation of said inverter.

5. The inverter circuit of claim 1 further comprising a means for initiating conduction in a discharge type lamp through ionization of the gases contained in the lamp through the application of a DC potential across the terminals of the lamp through said secondary winding of said transformer, such means consisting of;

an additional secondary winding on said transformer which produces a relatively high AC potential;

a rectifier to convert said AC potential to said DC potential, said rectifier being connected in series with a high value current limiting resistor;

one terminal of said additional secondary winding connected to said ballasting capacitor and the opposite end of said additional secondary winding connected to one terminal of said rectifier/current limiting resistor network, the other terminal of said rectifier/current limiting resistor network connected to the opposite end of said ballasting capacitor.

6. The inverter circuit of claim 1 wherein a means is provided for detection of ignition or failure of a discharge lamp, such means comprising;

an additional sense winding placed on said transformer such that an AC voltage or current may be extracted, the frequency of the wave extracted being equal to the frequency of oscillation of the circuit and;

any of several circuits currently known in the art for detecting a frequency and generating an output signal, the input terminal of this circuit being connected to the terminals of said sense winding on said transformer and the output terminal of this circuit connected to any of several other circuits which may be used in such a manner as may be appropriate for the application, e.g., shutdown of said inverter or said DC source at input terminals of said inverter in case of lamp failure or failure to ignite or alternatively for remote sensing of inverter operation or lamp condition.

* * * * *